US008469329B2

(12) United States Patent
Tygard

(10) Patent No.: US 8,469,329 B2
(45) Date of Patent: Jun. 25, 2013

(54) MERCHANDISE PALLET

(75) Inventor: Edward Tygard, McMurray, PA (US)

(73) Assignee: Tygard Machine & Manufacturing Company, Washington, PA (US)

( * ) Notice: Subject to any disclaimer, the term of this patent is extended or adjusted under 35 U.S.C. 154(b) by 732 days.

(21) Appl. No.: 12/385,166

(22) Filed: Mar. 31, 2009

(65) Prior Publication Data

US 2009/0263228 A1 Oct. 22, 2009

Related U.S. Application Data

(60) Provisional application No. 61/064,890, filed on Apr. 1, 2008.

(51) Int. Cl.
*F16M 11/38* (2006.01)

(52) U.S. Cl.
USPC ..... 248/436; 248/346.02; 248/499; 108/55.5

(58) Field of Classification Search
USPC ..... 248/436, 499, 346.01, 346.02, 346.03, 248/292.12, 292.11; 24/68 CD, 909, 68 R, 24/68 CT, 69 ST, 71 ST, 71 TD; 108/53.1, 108/51.11, 57.15, 57.32, 55.1–55.5; 254/219, 254/222, 367, 376, 213, 217, 364, 218, 250–252; 410/100, 97, 121, 103
See application file for complete search history.

(56) References Cited

U.S. PATENT DOCUMENTS 4,185,360 A * 1/1980 Prete et al. ..... 24/68 CD
4,273,484 A * 6/1981 Blanar ..... 410/12
4,510,652 A * 4/1985 van Iperen ..... 24/68 CD
4,542,883 A * 9/1985 Rutzki ..... 254/217
4,960,353 A * 10/1990 Thorndyke ..... 410/20
5,180,262 A * 1/1993 Westerdale ..... 410/12
5,186,586 A * 2/1993 Stephenson, Jr. ..... 410/100
5,312,213 A * 5/1994 Winsor ..... 410/9
5,316,421 A * 5/1994 Bullock et al. ..... 410/9
5,338,136 A * 8/1994 Hetchler ..... 410/100
5,441,371 A * 8/1995 Erke ..... 410/100
5,460,465 A * 10/1995 Little ..... 410/100
5,490,749 A * 2/1996 Arbues ..... 410/103
5,853,164 A * 12/1998 Hunt ..... 254/213
5,860,777 A * 1/1999 Walsh et al. ..... 410/100
6,141,840 A * 11/2000 Berkes ..... 24/633
6,216,607 B1 * 4/2001 Cuddy ..... 108/55.5
6,398,470 B1 * 6/2002 Mosley ..... 410/100
6,524,040 B1 * 2/2003 Heil ..... 410/67
6,530,729 B2 * 3/2003 Tatina ..... 410/7
6,547,218 B2 * 4/2003 Landy ..... 254/217
6,626,621 B1 * 9/2003 Hugg ..... 410/103

(Continued)

*Primary Examiner* — Terrell McKinnon
*Assistant Examiner* — Monica Millner
(74) *Attorney, Agent, or Firm* — Michael Tobias

(57) ABSTRACT

A pallet for use in transporting merchandise includes a pallet body having a top surface for supporting merchandise. A foot-driven winch is mounted on the pallet body, and a flexible tie-down for restraining merchandise on the pallet body is connected to the winch. In a preferred method of using the pallet, a plurality of such pallets are disposed inside a vehicle with the pallets defining a surface which substantially spans the width of the floor of the vehicle and on which a delivery person can stand to access merchandise on the pallets. The delivery person can remove merchandise from the pallets while remaining inside the vehicle and then can move the merchandise to outside the vehicle without having to perform any lifting. As a result, sickness of delivery persons due to exposure to the weather during delivery and injuries due to lifting of merchandise can be decreased.

33 Claims, 14 Drawing Sheets

U.S. PATENT DOCUMENTS

| | | | | |
|---|---|---|---|---|
| 6,817,578 | B1 * | 11/2004 | Garcia et al. | 244/137.1 |
| 6,821,068 | B2 * | 11/2004 | Facey et al. | 410/100 |
| 6,929,438 | B1 * | 8/2005 | Foster et al. | 410/46 |
| 7,260,870 | B2 * | 8/2007 | Vick | 24/16 R |
| 7,329,075 | B2 * | 2/2008 | Boydstun et al. | 410/100 |
| 7,350,767 | B2 * | 4/2008 | Huang | 254/218 |
| 7,350,768 | B1 * | 4/2008 | Chang | 254/218 |
| 7,410,334 | B2 * | 8/2008 | McGrew | 410/100 |
| 7,448,835 | B1 * | 11/2008 | Forrester et al. | 410/46 |
| 7,476,069 | B2 * | 1/2009 | Facey et al. | 410/100 |
| 7,618,021 | B2 * | 11/2009 | Leone et al. | 254/223 |
| 7,632,052 | B2 * | 12/2009 | Tatina | 410/20 |
| 7,752,717 | B2 * | 7/2010 | Hanson | 24/68 CD |
| 7,758,023 | B2 * | 7/2010 | Chang | 254/218 |
| 7,874,047 | B2 * | 1/2011 | Breeden | 24/68 CD |
| 8,096,740 | B1 * | 1/2012 | Parker et al. | 410/103 |
| 2002/0094258 | A1 * | 7/2002 | Iwasaki et al. | 414/392 |
| 2002/0195027 | A1 * | 12/2002 | Mallan et al. | 108/55.3 |
| 2003/0031524 | A1 * | 2/2003 | Brunet | 410/100 |
| 2003/0059269 | A1 * | 3/2003 | Bosley | 410/100 |
| 2004/0037665 | A1 * | 2/2004 | Im | 410/103 |
| 2004/0101380 | A1 * | 5/2004 | Facey et al. | 410/100 |
| 2004/0155230 | A1 * | 8/2004 | Fortin | 254/219 |
| 2007/0114504 | A1 * | 5/2007 | Ruan | 254/223 |
| 2007/0267611 | A1 * | 11/2007 | Leone et al. | 254/218 |
| 2007/0269285 | A1 * | 11/2007 | Leggett | 410/100 |
| 2008/0012260 | A1 * | 1/2008 | Ouyang et al. | 280/79.11 |
| 2008/0250986 | A1 * | 10/2008 | Boon | 108/53.1 |
| 2009/0100653 | A1 * | 4/2009 | Wang | 24/68 CD |

* cited by examiner

MERCHANDISE PALLET

REFERENCE TO RELATED APPLICATIONS

This application claims the benefit of U.S. Provisional Application No. 61/064,890 filed on Apr. 1, 2008, the disclosure of which is incorporated by reference.

BACKGROUND OF THE INVENTION

This invention relates to a pallet for use in transporting merchandise. In particular but not exclusively, it relates to a pallet which can facilitate the delivery of beverages such as beer and soft drinks.

Beer and soft drinks are commonly transported from distributors to retail establishments such as supermarkets, convenience stores, bars, and restaurants by special-purpose delivery trucks. A delivery truck of this type usually has roll-up doors on the sides of the truck which can be raised to allow the driver to access storage bays inside the truck. The storage bays can be loaded with merchandise at a warehouse with a fork lift. However, merchandise is usually unloaded from the delivery truck by hand. When the driver of such a delivery truck is making deliveries to a retail establishment, he rolls up one or more of the doors of the truck, removes the desired beverages by hand from one or more of the storage bays, and places the beverages on a hand cart. The driver then rolls the loaded hand cart to the appropriate location within the retail establishment where the beverages are to be delivered. Beverages stacked in the storage bays of the delivery truck may be 6 or more feet off the ground, so transferring beverages between the storage bays and a hand cart requires significant physical effort on the part of the driver, which makes the work both tiring and the cause of injuries, such as back injuries. In addition, since the roll-up doors are on the outside of the delivery truck, the driver is frequently exposed to the weather while making a delivery. Thus, conventional beverage delivery trucks impose a significant physical strain on drivers, and work absences by delivery truck drivers due to sickness or injury are a frequent problem and a significant expense for beverage wholesalers and delivery companies which use such delivery trucks.

SUMMARY OF THE INVENTION

The present invention provides a pallet for use in transporting merchandise which can reduce the physical burden on a worker making deliveries of the merchandise.

The present invention also provides a pallet arrangement for use with a vehicle such as a delivery truck and a method of arranging pallets within a delivery truck.

The present invention additionally provides a method of securing merchandise on a pallet.

The present invention further provides a method of using a pallet to deliver merchandise.

According to one form of the present invention, a pallet includes a pallet body having a top surface for supporting a load. A foot-driven winch is mounted on the pallet body, and a flexible tie-down for restraining a load on the pallet body is connected to the winch. The winch can preferably be operated by the foot of a user standing on the top surface of the pallet body. In preferred embodiments, the winch includes a kick wheel which can be rotated by foot to rotate the winch to roll up the tie-down on the winch and tighten the tie-down against the load.

The tie-down is preferably capable of being detachably connected to the pallet in any of a plurality of locations.

According to another form of the present invention, a pallet arrangement comprises a plurality of pallets disposed on the floor of a vehicle such as a delivery truck such that the pallets define a surface substantially spanning the width of the floor of the truck. Loads can be disposed on the pallets on so as to define one or more aisles along which a worker can roll a hand cart to access the loads.

According to yet another form of the present invention, a method of restraining an item on a pallet comprises passing a tie-down over the item and then rotating a kick wheel of a winch connected to the tie-down by foot to tighten the tie-down against the item.

According to a further form of the present invention, a method of delivering merchandise includes securing an item of merchandise to each of a plurality of pallets and transporting the loaded pallets into a vehicle such as a delivery truck and placing the pallets on a floor of the vehicle in a plurality of rows and columns to define a surface substantially spanning a width of the floor of the vehicle. The items are disposed so as to define an aisle along which a hand cart can be rolled atop the surface. The vehicle is driven to a location to which merchandise is to be delivered, a hand cart is rolled along the aisle to an item to be delivered, the item is transferred from the pallet to the hand cart, and the loaded hand cart is rolled along the aisle and out of the vehicle.

A pallet according to the present invention is not restricted to use with any particular type of merchandise, but it is particularly advantageous when used in the transport of beverages such as beer or soft drinks from a warehouse or factory to a retail establishment.

DESCRIPTION OF PREFERRED EMBODIMENTS

Figure 1:
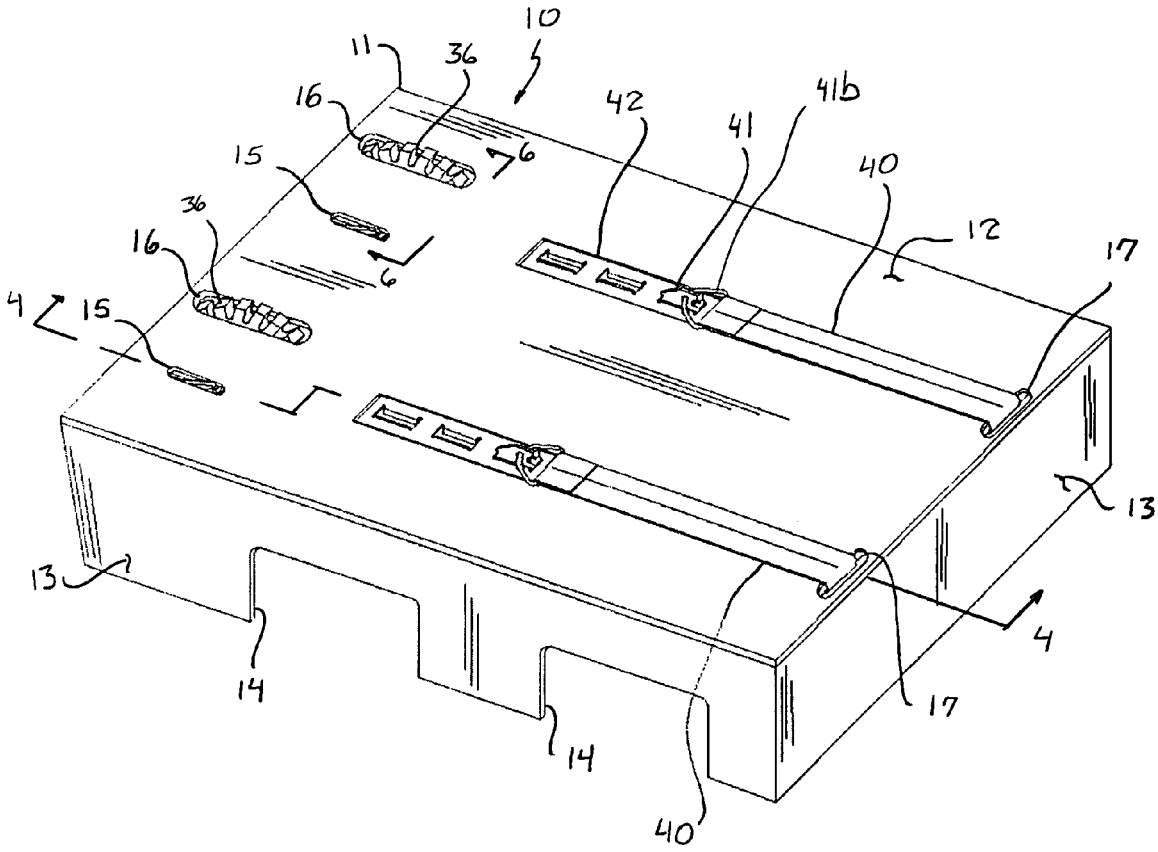
FIG. 1 is a top axonometric view of an embodiment of a pallet according to the present invention.

A number of preferred embodiments of a merchandise pallet according to the present invention will be described while referring to the accompanying drawings. FIG. 1 is a top axonometric view of one embodiment of a pallet 10 according to the present invention. Like a typical pallet for use with a fork lift, the illustrated pallet 10 includes a body 11 having a rigid deck 12 with a top surface 12*a* for supporting a load and a support structure which elevates the deck 12 above a floor or other surface on which the pallet 10 is disposed so that the forks of a fork lift can be placed underneath the deck 12. In the present embodiment, the support structure comprises four side walls 13 which extend downwards from the deck 12. Alternatively, legs, blocks, posts, or the like may be employed instead of side walls as a support structure. The pallet 10 will typically have at least one opening for receiving the forks of a fork lift in at least one of its sides. In the present embodiment, two openings 14 for receiving the forks of a fork lift are formed in each of two opposing side walls 13 of the pallet body 11. The direction in which the forks of a fork lift extend when inserted into these openings 14 will be referred to as the lengthwise direction of the pallet 10, and the horizontal direction perpendicular to the lengthwise direction will be referred to as the widthwise direction of the pallet 10.

The pallet body 11 can be made of a wide variety of materials, such as any of the materials typically used for pallets for use with fork lifts, including wood, metal, and plastic. The pallet body 11 is not restricted to having any particular structure, and it may, for example, have the same overall structure as the body of a conventional pallet. By way of example, the deck 12 of the pallet body 11 may comprise slats, one or more plates or sheets, or a grid. Although not shown, openings for weight reduction, ventilation, or drainage, for example, may be provided in the deck 12 or side walls 13 of the pallet body 11. The top surface 12*a* of the pallet body 11 may be substantially planar, but it is also possible for it to have variations in height, such as indentations for receiving loads. In the illustrated embodiment, the deck 12 comprises a steel plate, and the side walls 13 comprise steel plates welded to the outer edges of the deck 12. Unillustrated stiffeners may be secured to the underside of the deck 12 to increase its rigidity and make the deck 12 a substantially rigid member. The deck 12 is preferably sufficiently rigid that a delivery person can stand atop the deck 12, roll a loaded hand cart atop the deck 12, and place loads of merchandise atop the deck 12 without the deck 12 undergoing significant bending deformation.

The illustrated pallet body 11 is open at its lower end over the entire region bounded by the side walls 13, and the only portions of the pallet body 11 which contact a surface on which the pallet 10 is resting are the lower ends of the side walls 13. However, it is also possible for the lower end of the pallet body 11 to be partially or entirely closed off by plates, slats, boards, or flanges, for example, secured to the lower ends of the side walls 13.

Figure 2:
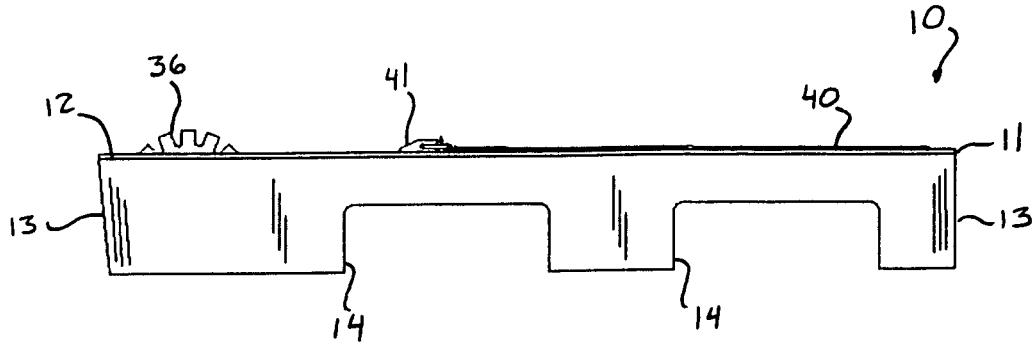
FIG. 2 is an elevation of the pallet of FIG. 1 as viewed from one of its lengthwise ends.

As best shown in FIG. 2, which is an elevation of one of the lengthwise ends of the pallet 10 of FIG. 1, in the present embodiment, at least one of the side walls 13 of the pallet body 11 (in this case a side wall 13 at one of the widthwise ends of the pallet body 11 and specifically the left widthwise end in FIG. 2) is sloped inwards from the top towards the bottom of the pallet body 11. When it is desired to place two pallets 10 next to each other on a flat surface with their widthwise ends facing each other, if one pallet is accidentally placed so that its widthwise end overlaps the widthwise end of an adjoining pallet, the upper of the two pallets can slide downwards along its sloping side wall 13 until it is level with the adjoining pallet. A sloping side wall 13 may be provided at both widthwise ends of a pallet 10, and it may be also be provided on one or both of the lengthwise ends. An example of an angle of slope of the sloping side wall 13 is in the range of 4 to 10 degrees with respect to the vertical.

Figure 3:
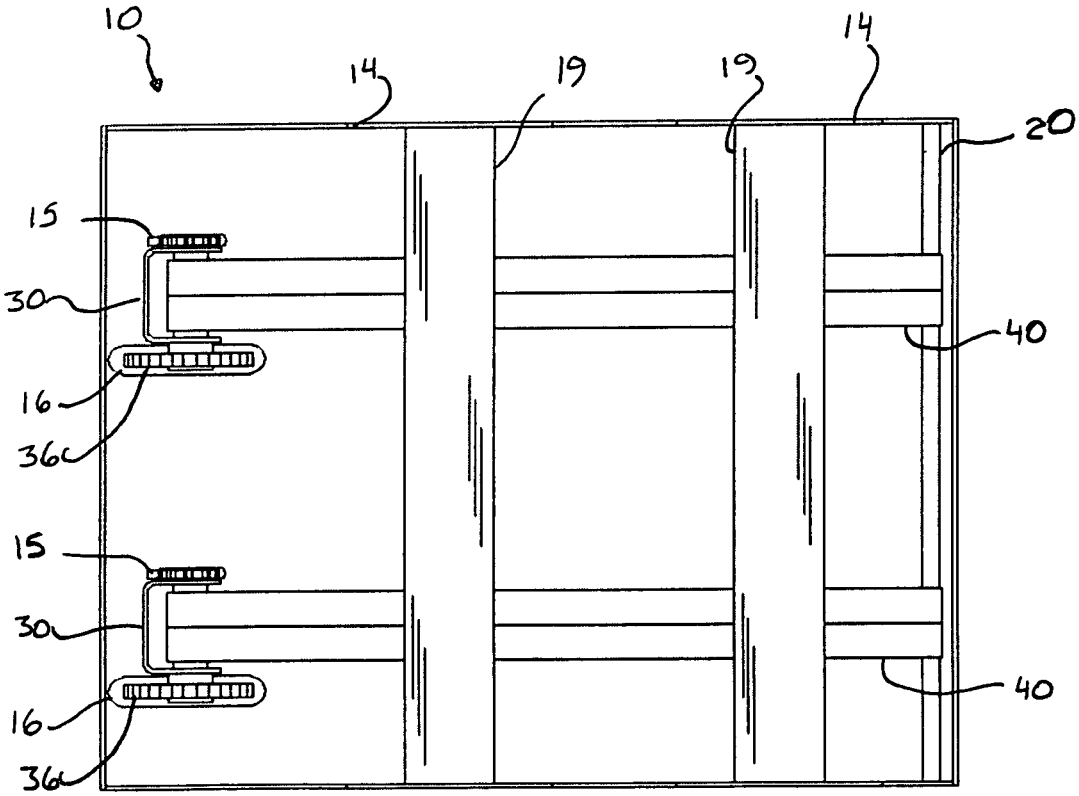
FIG. 3 is a bottom plan view of the pallet of FIG. 1.

As shown in FIG. 3, which is a bottom plan view of the pallet 10 of FIG. 1, the pallet 10 includes one or more foot-driven winches 30 mounted on the pallet body 11. An elongated flexible tie-down 40 which can be passed over a load disposed atop the pallet body 11 is wrapped around each winch 30. Each winch 30 can be operated by foot to pull the tie-down 40 firmly against a load or to loosen the tie-down 40 to enable the load to be removed from the pallet 10. The illustrated embodiment includes two winches 30, but a pallet may be equipped with a larger or smaller number of winches.

The winches 30 can be mounted on the pallet body 11 in any convenient location, including on an exterior surface of the pallet body 11 such as on top of the deck 12 or on an exterior surface of one of the side walls 13. Preferably, however, each winch 30 is disposed mostly or entirely underneath the deck 12 so as to protect the winches 30 from damage, so as not to interfere with the placement of a load atop the deck 12, so as to make it easier to stack empty pallets atop each other, and to make it possible to place adjoining pallets with their sides as close to each other as possible. Preferably the winches 30 are installed so that they can be operated by a person standing atop the deck 12 of a pallet 10.

Figure 5:
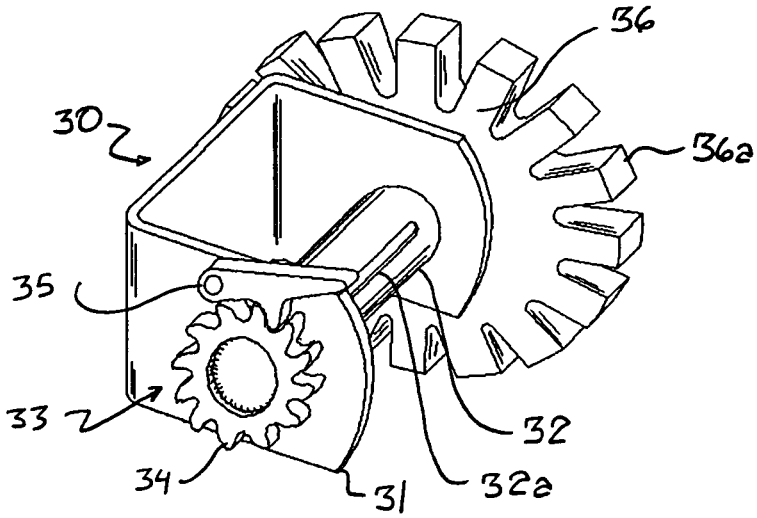
FIG. 5 is a top axonometric view of one of the winches of the pallet of FIG. 1 with the tie-down for the winch removed for clarity.
Figure 6:
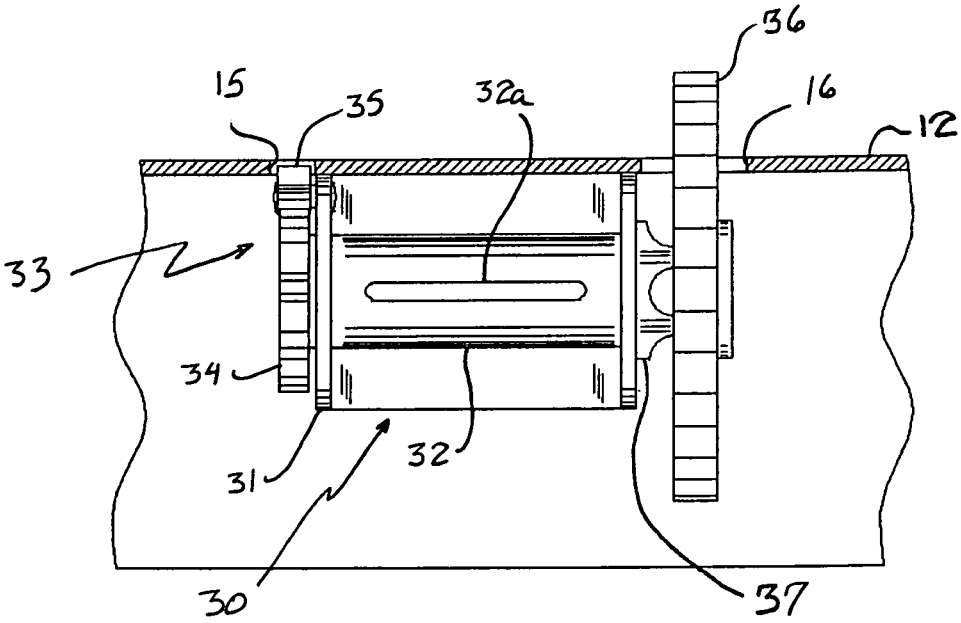
FIG. 6 is a cross-sectional elevation taken along line 6-6 of FIG. 1.

FIG. 5 is a top axonometric view showing the structure of one of the winches 30 of this embodiment in detail as it would appear when removed from the pallet body 11, while FIG. 6 is a cross-sectional elevation taken along line 6-6 of FIG. 1 and showing the winch 30 in detail as it appears when mounted on the pallet body 11. For clarity, the tie-down 40 for use with the winch 30 has been omitted from FIGS. 5 and 6. Each winch 30 can have any structure which enables it to be driven by the foot of a user to tighten or loosen a tie-down wrapped around the winch by rotation of the winch, and the overall structure of the winches may be similar to that of conventional winches which are commonly used for tightening straps employed for securing loads to pallets or trucks. Each of the illustrated winches 30 includes a generally U-shaped metal frame 31 which can be secured to the pallet body 11 and a rotatable member 32, referred to as a drum, which is rotatably supported by the frame 31 and around which a tie-down 40 can be wrapped. In the present embodiment, the frame 31 is secured to the underside of the deck 12. The drum 32 is not restricted to any particular structure. For example, it may comprise a cylindrical metal tube which is rotatably supported at its ends by the frame 31. The drum 32 will typically include structure which enables an end of a tie-down 40 to be secured to the drum 32. For example, the illustrated drum 32 includes an elongated slot 32*a* through which one end of the tie-down 40 can be inserted.

Each winch 30 may include a ratchet mechanism 33 for allowing the drum 32 to rotate in a first direction while selectively preventing rotation in the opposite direction. The illustrated ratchet mechanism 33, which may be of conventional structure, includes a ratchet wheel 34 secured to the drum 32 (such as by welding, press fitting, or some type of connector) so as to rotate therewith and a pawl 35 which is pivotably mounted on the frame 31 for movement with respect to the ratchet wheel 34 between an engaged position and a disengaged position. When the pawl 35 is in its engaged position, it permits rotation of the ratchet wheel 34 and the drum 32 in the clockwise direction in FIG. 5 but prevents rotation of the ratchet wheel 34 and the drum 32 in the counterclockwise direction by fitting into a space between adjoining teeth of the ratchet wheel 34. When the pawl 35 is pivoted to its disengaged position in which it does not contact the teeth of the ratchet wheel 34, the ratchet wheel 34 and the drum 32 are free to rotate in either rotational direction.

Each winch 30 also includes a member referred to as a kick wheel 36 by which a worker can rotate the drum 32 with his foot to operate the winch 30. The kick wheel 36 can be supported in any manner that enables it to rotate the drum 32. In the present embodiment, each winch 30 includes a short, perforated, tubular shaft 37 which is secured to one end of the drum 32, and the kick wheel 36 fits over one end of the shaft 37 and is secured thereto. The kick wheel 36 can have any shape which enables it to be rotated by the foot of a worker standing atop the pallet 10. In the present embodiment, the kick wheel 36 comprises a gear having a plurality of teeth 36*a* projecting radially from its periphery. Examples of other possible forms of the kick wheel 36 are a disk, a cylindrical member such as a tube or a cage, and a polygonal member such as a polygonal plate.

Figure 7:
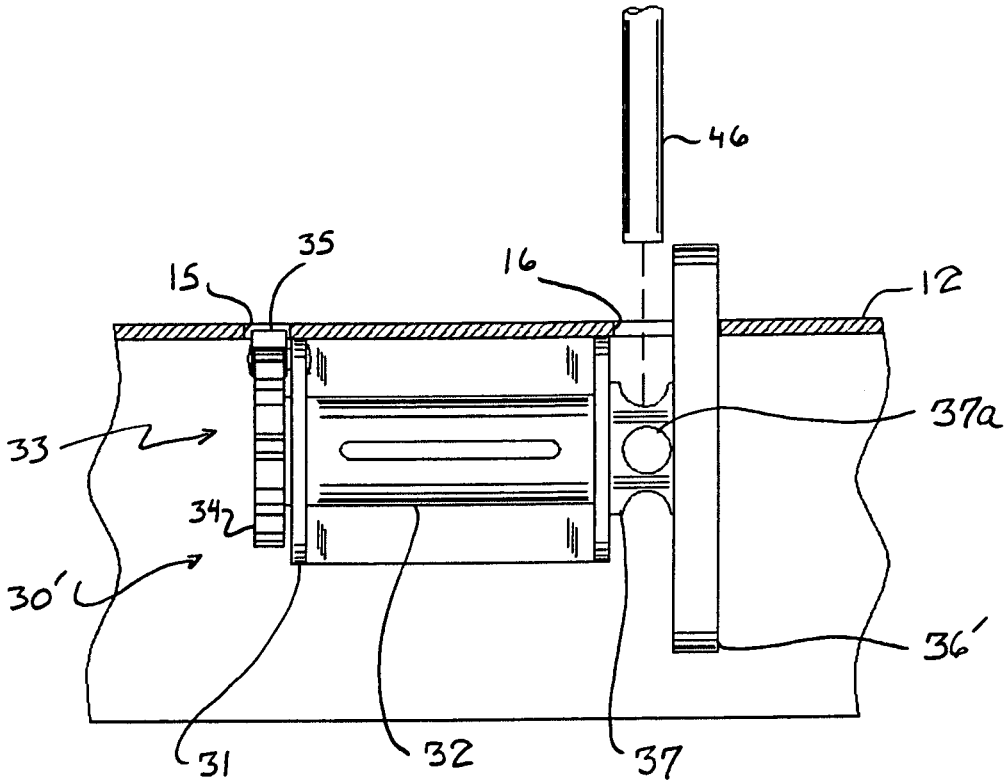
FIG. 7 is a cross-sectional elevation similar to FIG. 6 of a portion of a pallet equipped with a variation of the winch of FIG. 5.

FIG. 7 is a cross-sectional elevation similar to FIG. 6 showing a portion of a pallet 10 equipped with a variation of the winch 30 of FIG. 5. The winch 30' in this example has the same overall structure as the winch 30 of FIG. 5, but instead of having a kick wheel 36 comprising a gear, it has a kick wheel 36' comprising a circular disk which is secured to the end of the tubular shaft 37 of the winch 30'. In the winch 30 of FIG. 6, the kick wheel 36 is installed on the shaft 37 as close to the winch frame 31 as possible, as a result of which it covers up the holes 37*a* which are typically formed in the shaft 37 of a commercially available winch. In the winch 30' of FIG. 7, the kick wheel 36' is secured closer to the outer end of the shaft 37 so that the holes 37*a* are not covered by the kick wheel 36'. This pallet otherwise has the same structure as the pallet 10 of FIG. 1.

Figure 8:
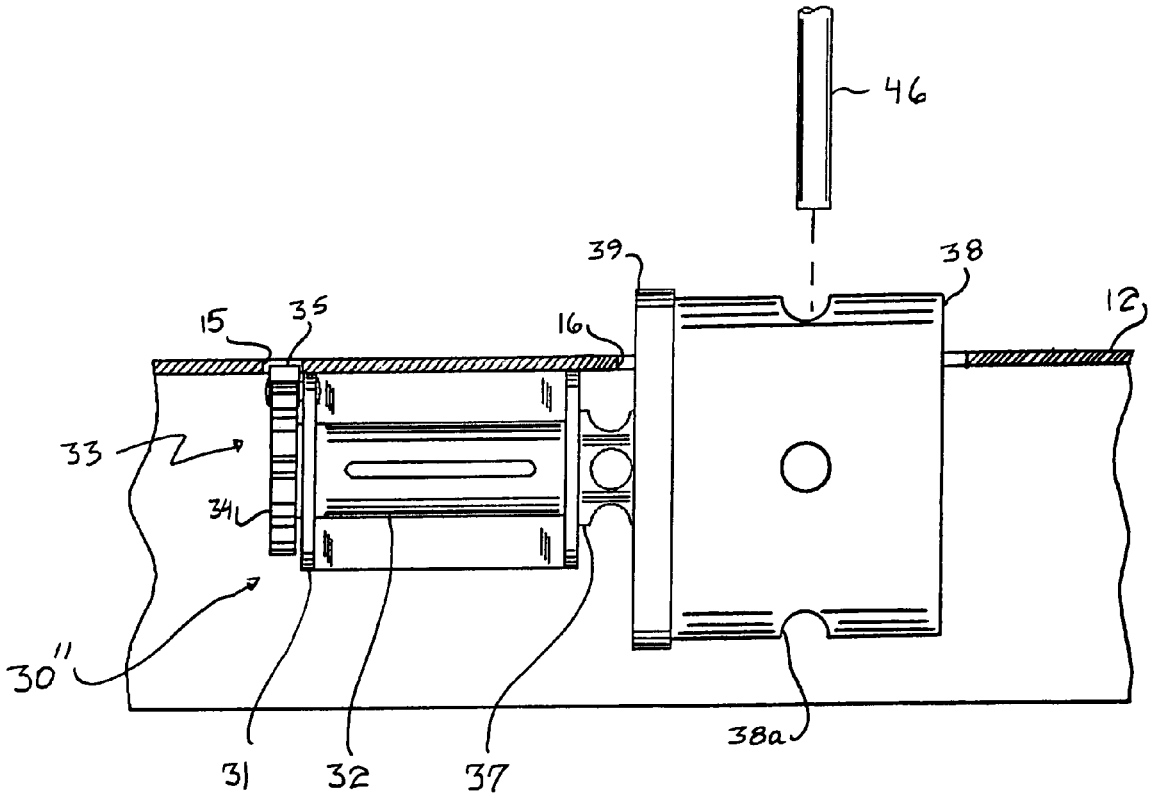
FIG. 8 is also a cross-sectional elevation similar to FIG. 6 of a portion of a pallet equipped with another variation of the winch of FIG. 5.

FIG. 8 is another cross-sectional elevation similar to FIG. 6 showing a portion of a pallet 10 equipped with a winch 30" which is a further variation of the winch 30 of FIG. 5. The overall structure of the winch 30" in this example is similar to that of the winch 30 of FIG. 5 but differs with respect to the structure of a kick wheel 38. The kick wheel 38 in this example comprises a cylinder, such as a short length of metal pipe, which is secured to the end of the tubular shaft 37 of the winch 30". One example of a method of securing the kick wheel 38 to the shaft 37 is to mount a circular disk 39 to the end of the shaft 37 by welding, for example, and then to secure the kick wheel 38 to a surface of the disk 39 by welding, for example. The length of the kick wheel 38 measured in its axial direction is not restricted, but the greater its length, the easier it is for a worker to rotate the kick wheel 38 with his foot. An example of a suitable length of the kick wheel 38 is on the order of 4-6 inches. The kick wheel 38 may have one or more holes 38*a* formed in its periphery into which a lever can be inserted in order to rotate the kick wheel 38. This pallet otherwise has the same structure as the pallet 10 of FIG. 1.

In the winches of FIGS. 6-8, the ratchet mechanism 33 and the kick wheel 36, 36', or 38 are disposed at opposite ends of the drum 32, but they may also be disposed at the same end.

Winches equipped with a frame, a drum, a ratchet mechanism, and a perforated tubular shaft are commercially available as off-the-shelf components. The winches 30, 30', and 30" shown in FIGS. 6-8 can be manufactured by securing a kick wheel 36, 36', or 38 to one end of the tubular shaft 37 of a commercially available winch.

The ratchet mechanism 33 and the kick wheel 36 can preferably be operated from the top side of the pallet 10 by a person standing atop the pallet 10. To enable such operation, the deck 12 of the pallet 10 may be formed with one or more openings for allowing access to the pawl 35 of the ratchet mechanism 33 and the kick wheel 36. As shown in FIG. 1, for each winch 30, a first slot 15 is formed in the deck 12 above the upper end of the pawl 35, and a second slot 16 is formed in the deck 12 above the kick wheel 36. The kick wheel 36 extends through the top surface 12*a* of the pallet body 11 through the second slot 16 by a sufficient distance (such as approximately ½ inch or less and even as little as ⅛ inch or less) for it to be engaged and rotated by the foot of a worker.

Alternatively, the upper end of the kick wheel 36 may be disposed flush with or below the top surface 12*a* of the deck 12 of the pallet 10, and an opening in the deck 12, such as the second slot 16, for accessing the kick wheel 36 can be made wide enough for a worker to insert a portion of his foot into the opening to rotate the kick wheel 36. The same is true of the kick wheels 36' and 38 of FIGS. 7 and 8. The upper end of each pawl 35 is preferably disposed below the top surface 12*a* of the pallet body 11 to prevent the pawl 35 from being inadvertently operated by movement of objects being moved on the deck 12 of the pallet body 11 or by the foot of a worker.

Each tie-down 40 can be any flexible member capable of being wrapped around one of the drums 32 and passed around a load disposed atop the pallet 10 to secure the load to the pallet 10. In the present embodiment, each tie-down 40 comprises a strap (i.e., a flexible member having a width greater than its thickness) of the type commonly used with winches to secure a load on a flat bed truck, such as a polymeric woven strap available from Kinedyne Corporation. Other examples of tie-downs which are capable of being used, depending upon the characteristics of the load, are ropes and elastic cords such as bungee cords. Depending upon the nature of the load, it may also be possible to use a metal strap. However, when transporting beverages, a polymeric woven strap is particularly suitable because the broad area of the strap reduces damage to packaging and the strap can restrain a load on a pallet without it being necessary to apply a high tension to the strap.

Figure 4:
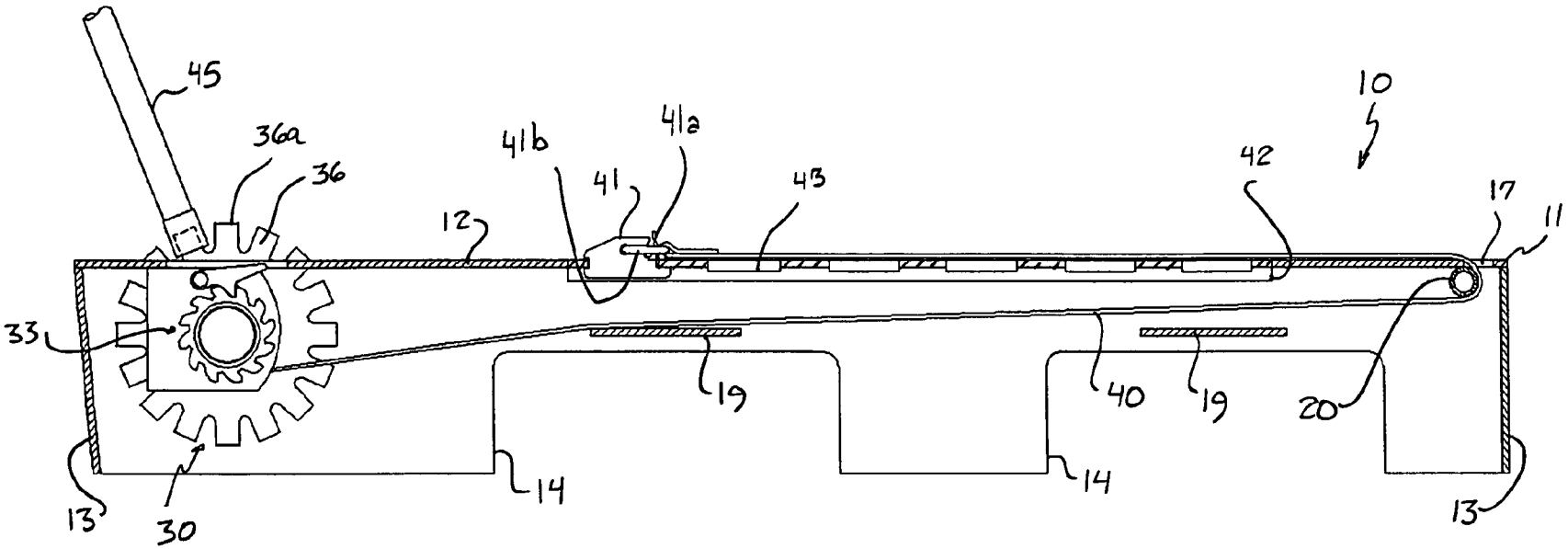
FIG. 4 is a cross-sectional view taken along line 4-4 of FIG. 1.
Figure 9:
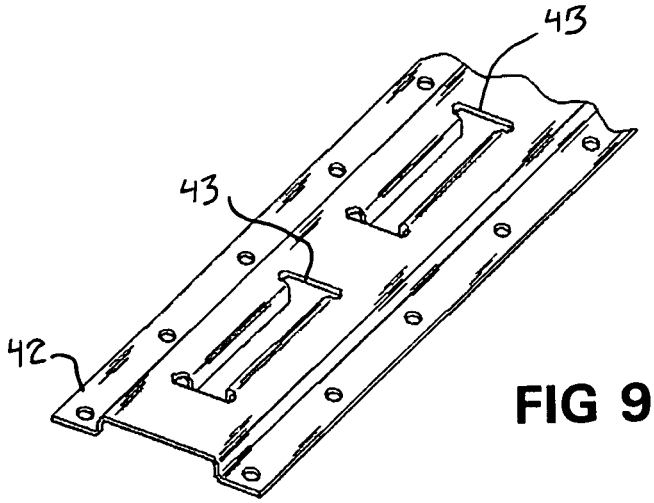
FIG. 9 is a top axonometric view of a portion of one of the tracks of the pallet of FIG. 1.

The end of each tie-down 40 which is secured to the drum 32 of one of the winches 30 (which will be referred to as the fixed end) can be passed through the slot 32*a* in the drum 32 and then wrapped around the drum 32. The other end of the tie-down 40 (which will be referred to as the free end) can be secured to the deck 12 of the pallet 10. The free end may be permanently fixed to the deck 12 of the pallet 10, and a load may be placed underneath the tie-down 40 by loosening the tie-down 40, sliding the load beneath the tie-down 40, and then tightening the tie-down 40 against the load. However, it is generally easier to secure and release a load disposed atop the pallet 10 if the free end of the tie-down 40 can be detachably secured to some portion of the pallet body 11, such as to the deck 12. In addition, it is convenient if the free end of the tie-down 40 can be secured to the pallet body 11 in a variety of locations in accordance with the size of the load which is to be restrained by the tie-down 40. Any of a wide variety of mechanisms can be used to secure the free end of the tie-down 40 to the pallet body 11, including hooks, rings, and pins. The present embodiment uses a detachable fitting 41 similar to that described in U.S. Pat. No. 4,867,623 and sold by Kinedyne Corporation as a "Series E Fitting". This fitting 41, which is schematically illustrated in FIG. 4, is designed for detachable engagement with a corresponding metal track 42. The fitting 41 has an operating lever 41*a* and a ring 41*b* which passes through a loop formed in the free end of the tie-down 40. FIG. 9 is a top axonometric view of a portion of the track 42. The track 42 comprises a metal strip having a plurality of elongated openings 43 punched in it at intervals along its length. The fitting 41 can be detachably inserted into any of the openings 43 in the track 42. The fitting 41 can be disengaged from the track 42 only when a worker first depresses the lever 41*a* of the fitting 41. Tracks and fittings of this type are commonly used with cargo winches on flat bed trucks. The illustrated track 42 is sold by Kinedyne Corporation as a "Series E Track Vertical". The track 42 can be mounted on the pallet body 11 by, for example, inserting it from below into an elongated slot formed in the deck 12 of the pallet 10 and securing the track 42 to the underside of the deck 12 by welding, rivets, bolts, or other suitable means. Alternatively, the track 42 can be directly mounted on the top surface 12*a* of the deck 12.

At a distance in the widthwise direction of the pallet 10 from where the winches 30 are installed, the deck 12 of the pallet 10 has two slots 17 through which the tie-downs 40 can pass between the lower side and the upper side of the deck 12. In order to reduce chafing of the tie-downs 40 as they pass through the slots 17, a smooth rod 20 may be secured to the underside of the pallet body 11 beneath the slots 17, and the tie-downs 40 may pass around the rod 20 before passing through the slots 17. Rollers may be mounted on the rod 20 to reduce the friction between the tie-downs 40 and the rod 20.

In order to prevent the forks of a fork lift from catching on the tie-downs 40 when being inserted into the openings 14 in the side walls 13, a member such as a guard plate 19 extending between opposite lengthwise ends of the pallet 10 may be disposed underneath the deck 12 above the openings 14 for forks, and the tie-downs 40 can pass above the guard plates 19 as shown in FIG. 4.

A worker standing atop the pallet 10 can apply a certain amount of tension to a tie-down 40 by rotating the corresponding kick wheel 36 with his foot. Each winch 30 may further include structure which enables a worker to apply a still higher tension to the tie-downs 40, i.e., to apply a higher torque to the winch 30 than is possible than by rotating the kick wheel 36 by foot. With the winch 30 shown in FIGS. 4-6, a worker can apply a torque to the winch 30 by engaging any of the teeth 36*a* on the periphery of the kick wheel 36 with a lever 45 having a hollow end sized to fit over any of the teeth 36*a*. FIG. 4 shows such a lever 45 engaged with one of the teeth 36*a* of the kick wheel 36 of one of the winches 30. The lever 45 can be used to perform the final tightening of the tie-down 40 against a load, and it can also be used to slightly rotate the ratchet wheel 34 (which rotates together with the kick wheel 36) in the clockwise direction in FIG. 4 when it is desired to disengage the pawl 35 from the ratchet wheel 34. If a kick wheel does not have teeth for engagement with a lever, such as when a kick wheel comprises a disk like the kick wheel 36' of the winch 30' shown in FIG. 7, a torque can be imparted to the winch 30' by inserting the end of a lever 46 through one of the second slots 16 in the deck 12 of the pallet body 11 into one of the holes 37*a* in the shaft 37 and then using the lever 46 to rotate the shaft 37. In the case of the kick wheel 38 of the winch 30" of FIG. 8, the end of a lever 46 can be inserted into one of the holes 38*a* in the kick wheel 38 to impart a torque to the winch 30".

Figure 10:
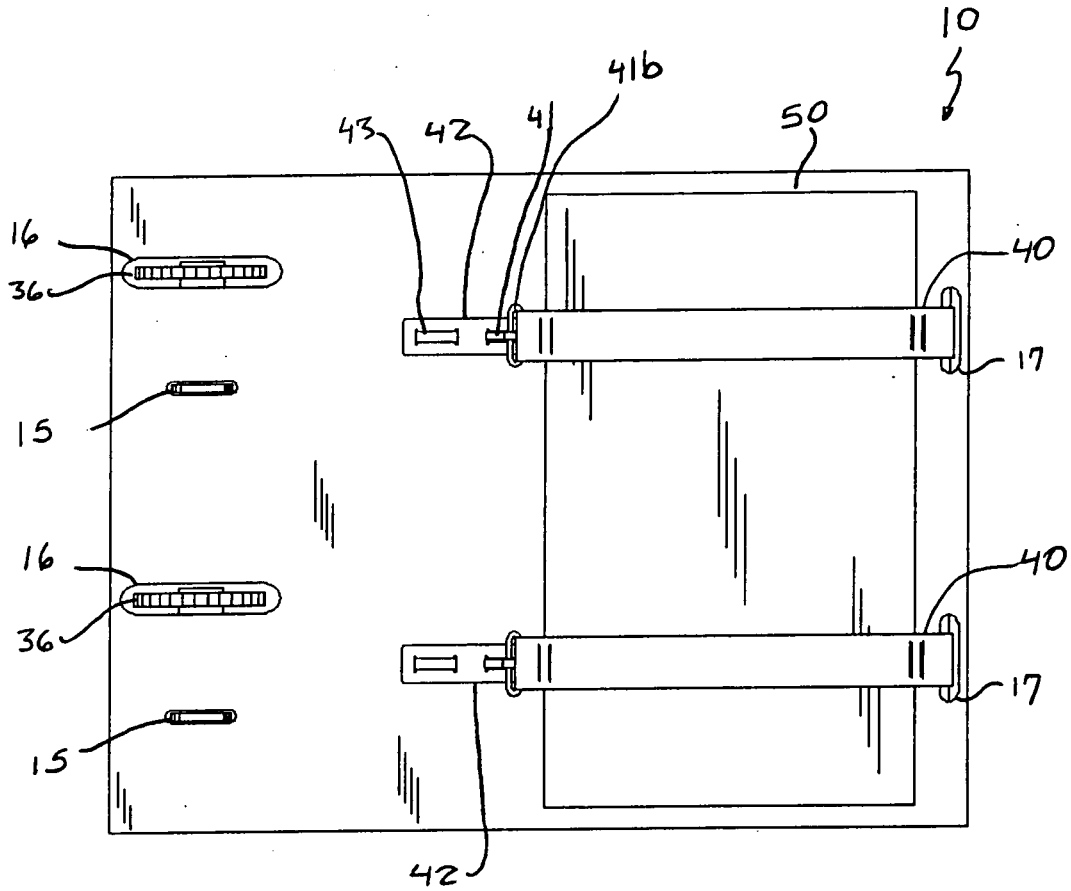
FIGS. 10-12 are plan views of pallets according to the present invention illustrating various ways of securing a load to the pallets.
Figure 11:
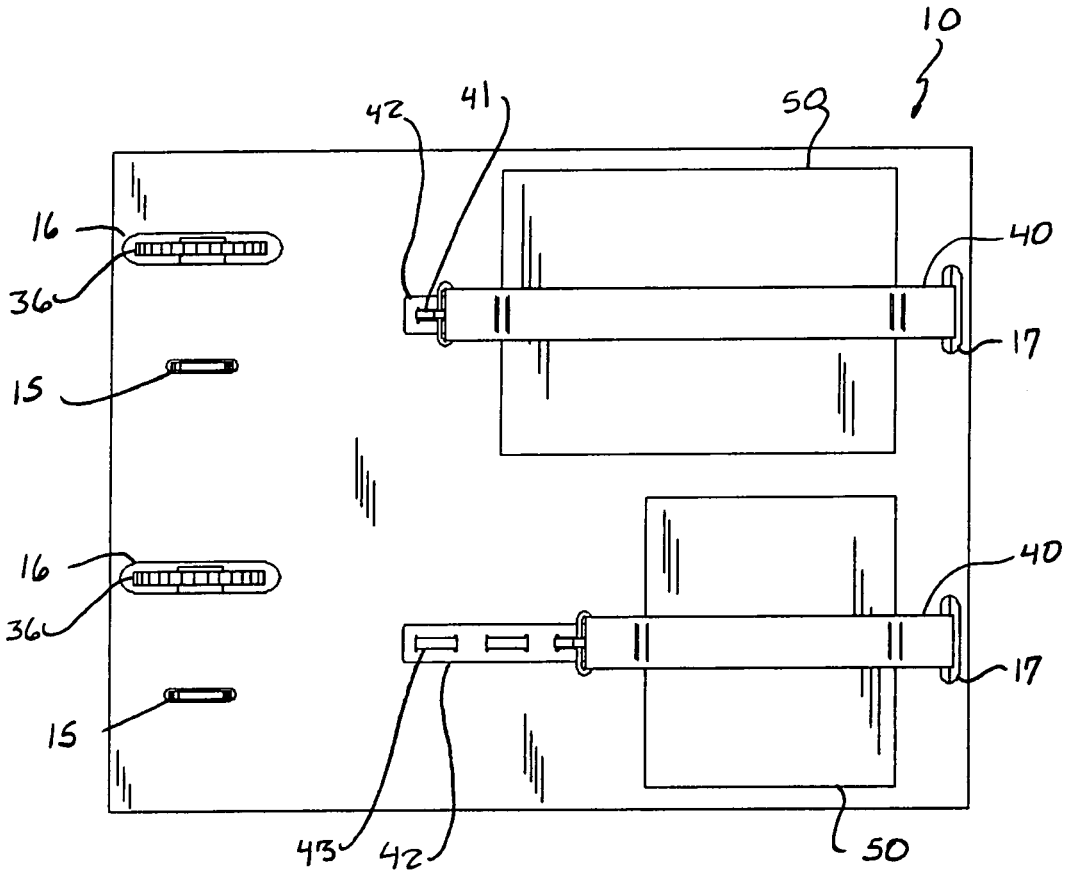
Figure 12:
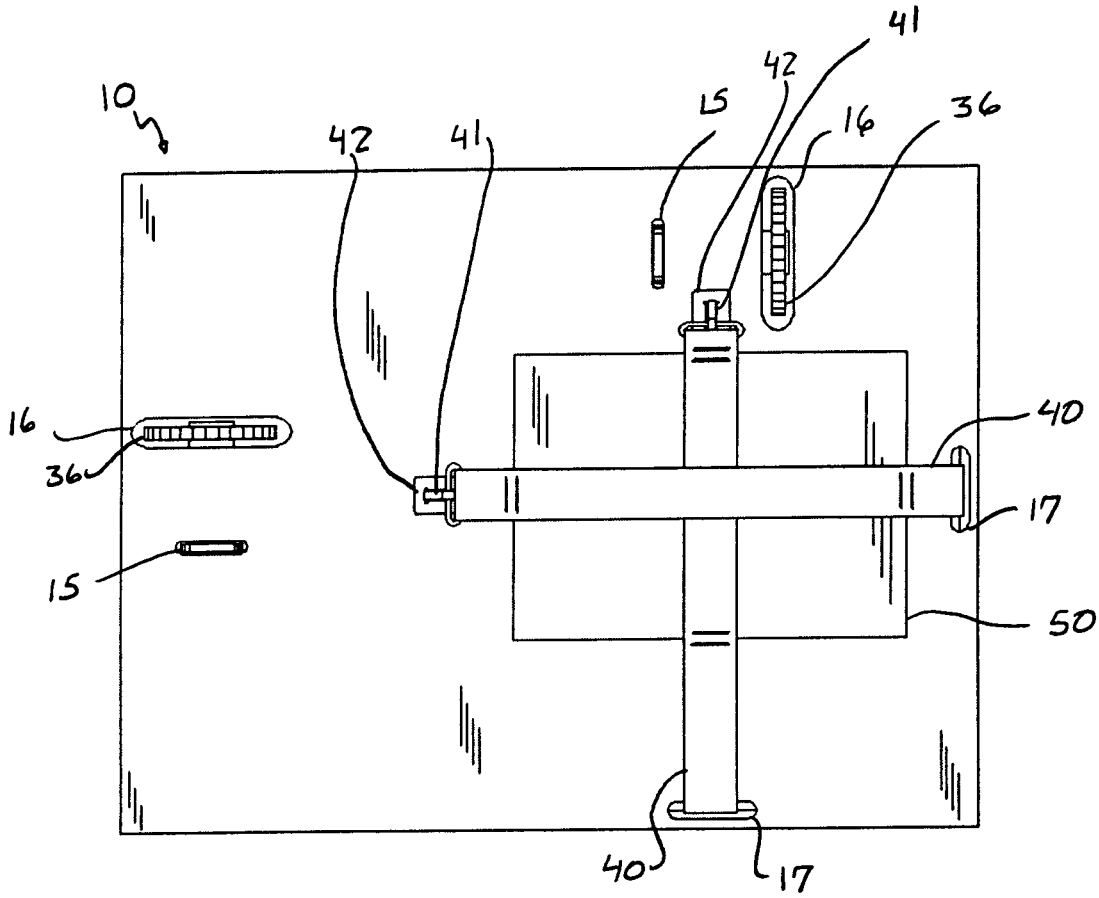

The pallet 10 of FIG. 1 can be used to support objects atop the pallet 10 in a variety of manners. Each tie-down 40 can be used to individually secure a separate load atop the pallet 10, or in the case of a large load, two or more tie-downs 40 can be used to secure a single load. FIG. 10 is a plan view of the pallet 10 of FIG. 1 showing a situation in which both tie-downs 40 are used to secure a single load 50 atop the pallet 10, while FIG. 11 is a plan view showing a situation in which each of the tie-downs 40 secures a separate load 50 atop the pallet 10. The two winches 30 in the embodiment of FIG. 1 have rotational axes which are parallel to each other, but it is also possible for a pallet 10 to have two winches having rotational axes which are at an angle to each other, such as perpendicular to each other, so that a load can be secured to tie-downs extending in two different directions. FIG. 12 is a plan view of a modification of the embodiment of FIG. 1 in which a pallet 10 includes two unillustrated winches which are disposed on the underside of the pallet body 11 and have their rotational axes perpendicular to each other. Similarly, two tracks 42 for engaging with the free ends of the tie-downs 40 are arranged at right angles to each other. In this arrangement, the tie-downs 40 for the two winches extend over a load 50 at right angles to each other. Except for the orientation of the winches with respect to each other, the structure of the embodiment of FIG. 12 can be the same as that of the embodiment of FIG. 1.

Figure 13:
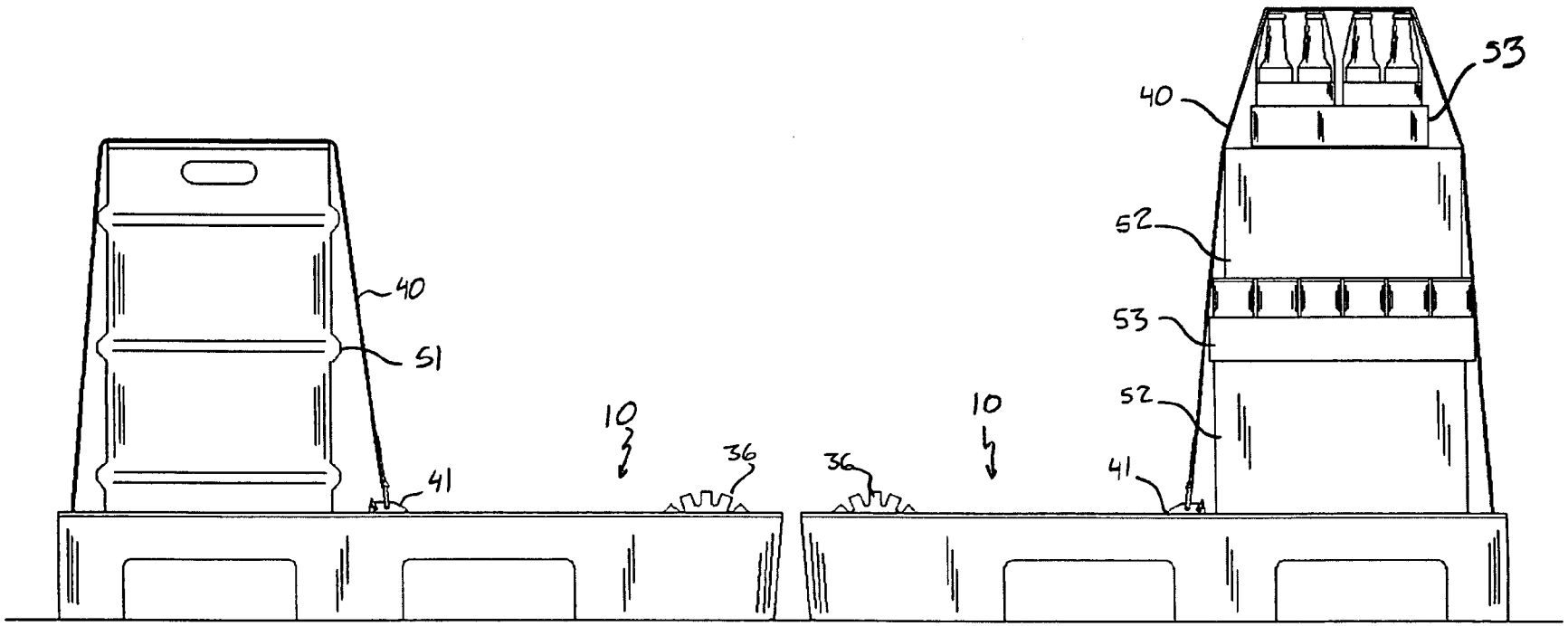
FIG. 13 is an elevation of two pallets according to the present invention disposed opposite each other, illustrating various types of loads which can be secured atop the pallets.

In FIGS. 10-12, a load 50 is schematically shown as a single rectangular object for ease of illustration, but the load which is restrained by a tie-down 40 can be a single object or a plurality of objects, such as one or more stacks of objects. The load may comprise any type of object capable of being supported on a pallet 10, but a pallet 10 according to the present invention is particularly suitable for use in the transport of beverages such as beer of soft drinks in cases, trays, cartons, or kegs, for example. When the pallet 10 is being used to transport beer or soft drinks, an example of a load comprising a single object is a beer keg or a soft drink canister, while an example of a load comprising a stack of objects is a plurality of cases or trays of bottles or cans. FIG. 13 is a schematic elevation of two pallets 10 according to the present invention supporting examples of different types of loads. The lefthand pallet 10 in FIG. 13 is supporting a load in the form of a beer keg 51 of the half-barrel size, while the right-hand pallet 10 in this figure is supporting a load comprising a stack containing two 24-bottle cases 52 of beer, a 24-can tray 53 of beer, and a tray 53 containing two six-bottle cartons of beer. To give some idea of the size and weight of these two loads, a half-barrel keg of beer has a height of approximately 23 inches and a full weight of approximately 160 pounds. The righthand stack of cases 52 and trays 53 typically has a height of approximately 35 inches and a weight of approximately 100 pounds. On account of the weight of the loads, it would take significant effort for a delivery person to unload these items from a conventional beverage delivery truck and place them on a hand cart. In contrast, with a pallet according to the present invention, a delivery person can place either load in its entirety onto a hand cart simply by sliding the nose of the hand cart underneath the load without the delivery person having to do any lifting.

Figure 14:
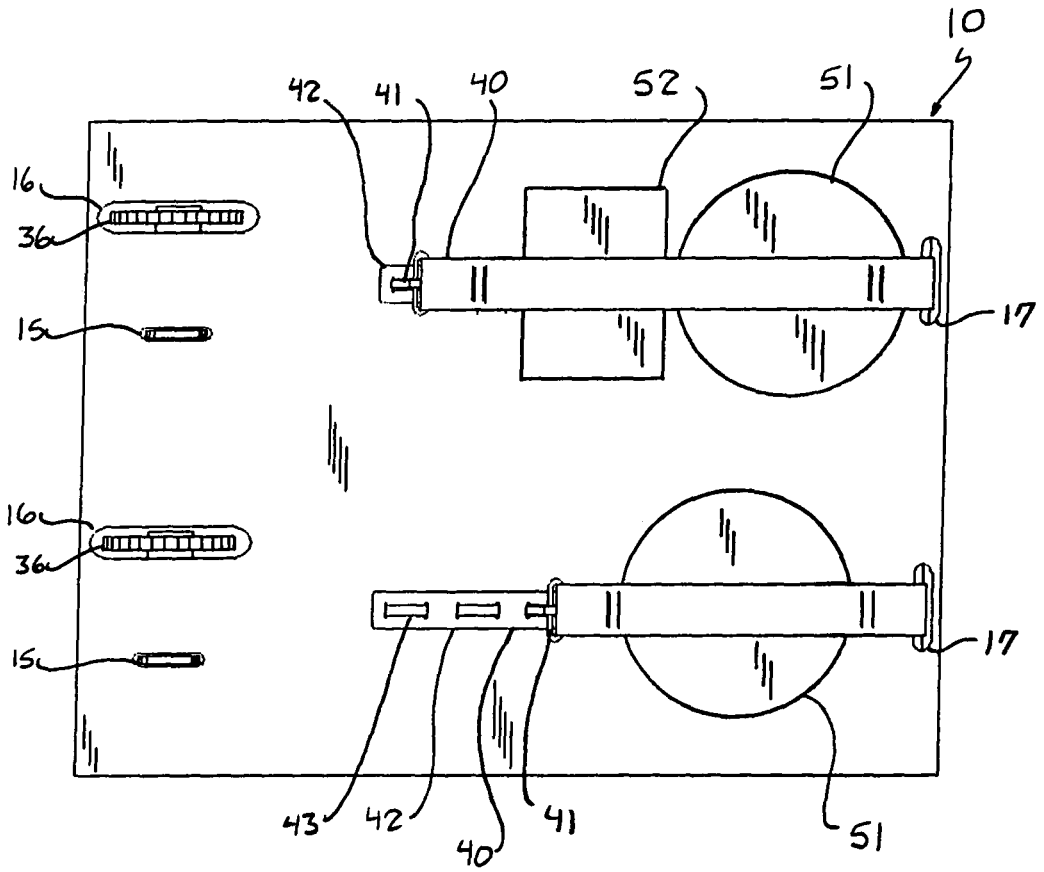
FIGS. 14 and 15 are schematic plan views of various arrangements of merchandise on a pallet according to the present invention.
Figure 15:
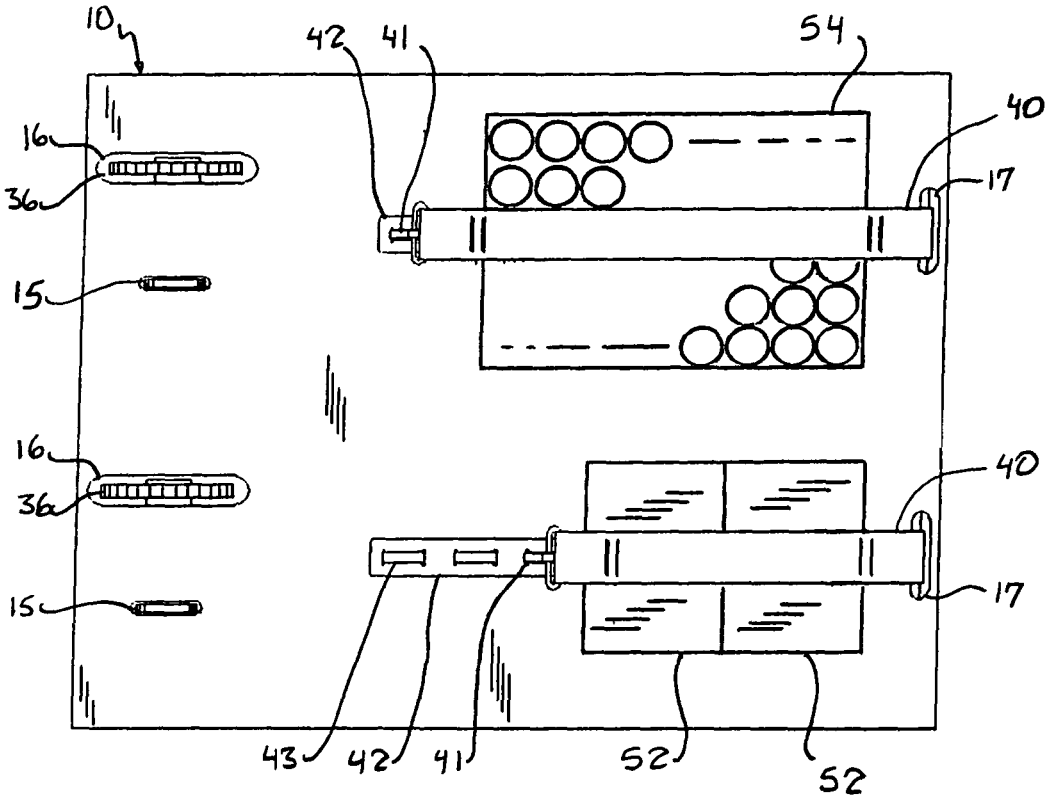

FIGS. 14 and 15 are plan views of two pallets 10 like the pallet 10 of FIG. 1 schematically showing common arrangements of loads when the pallets 10 are used for transporting beer or soft drinks. FIG. 14 shows an example in which one tie-down 40 is used to secure a half-barrel size beer keg 51 atop the pallet 10, while the other tie-down is used to secure a half-barrel size beer keg 51 and a 24-bottle case 52 of beer adjoining the keg 51 atop the pallet 10. A half-barrel size beer keg has a diameter of approximately 17 inches, while a typical 24-bottle case of beer typically measures on the order of 10×14 inches as viewed in plan. FIG. 15 shows an example in which one tie-down 40 is used to secure two 24-bottle cases 52 of beer side by side, and the other tie-down 40 is used to secure a 48-can tray 54 of beer (containing 8 six-packs of beer). A 48-can tray typically measures approximately 15×21 inches in plan. FIGS. 14-15 show merely a few examples of possible arrangements of beverages on a pallet according to the present invention, and any arrangement of merchandise which is capable of being stably held in place by one or more tie-downs 40 can be employed.

The shape of a pallet according to the present invention as viewed in plan will usually be rectangular (which includes a square shape) since vehicles, equipment, and buildings for handling pallets are usually designed for use with rectangular pallets, but other shapes are also possible.

The dimensions of a pallet according to the present invention are not restricted and can be selected in accordance with the size of the load or loads which the pallet is intended to support. Conventional pallets for use in the beverage industry are usually of a standard size, a few examples of which are 32×36 inches, 28×38 inches, 40×48, and 48×48 inches as measured in plan, and it is possible to use such dimensions for a pallet according to the present invention. Giving a pallet according to the present invention the same dimensions as a standard beverage pallet makes it possible to store the pallet when not in use in areas designed for use with standard pallets and makes it possible to handle the pallet with equipment designed for handling standard pallets. In one form of the present invention, a pallet according to the present invention has a width such that when a plurality of the pallets are disposed side by side in a delivery truck, their combined widths substantially span the interior width of the body of the delivery truck. For example, each pallet can have a width which is slightly less than ½ the width of the interior of the body of the delivery truck so that two pallets placed face to face can substantially span the width of the interior of the body of the delivery truck. The height of the pallet is also not restricted but is preferably at least large enough to enable the forks of a fork lift to be inserted beneath the deck of the pallet. An example of a typical height of the pallet is on the order of 6 inches.

A pallet according to the present invention is not restricted to use with any particular type of vehicle. For example, it can be used with conventional beverage delivery trucks, general-purpose delivery vans, pickup trucks, and flat bed trucks. However, it is particularly effective to use a pallet according to the present invention with a truck having a floor or a bed with a height above the ground such that the truck can be loaded and unloaded via a loading dock so as to make it unnecessary for the driver of the truck to manually raise and lower merchandise when loading or unloading the truck. Examples of such trucks designed for use with a loading dock are so-called box trucks and tractor-trailers. The truck preferably has an enclosed storage compartment for merchandise (such as the body of the truck in the case of a box truck and a trailer in the form of a tractor-trailer) with an interior which is tall enough for a worker to stand comfortably inside in the storage compartment while unloading merchandise and more preferably tall enough for a fork lift to be driven into the storage compartment to transport a loaded pallet into the storage compartment. An example of a suitable height of the interior of the storage compartment is 78 inches or more.

Figure 16:
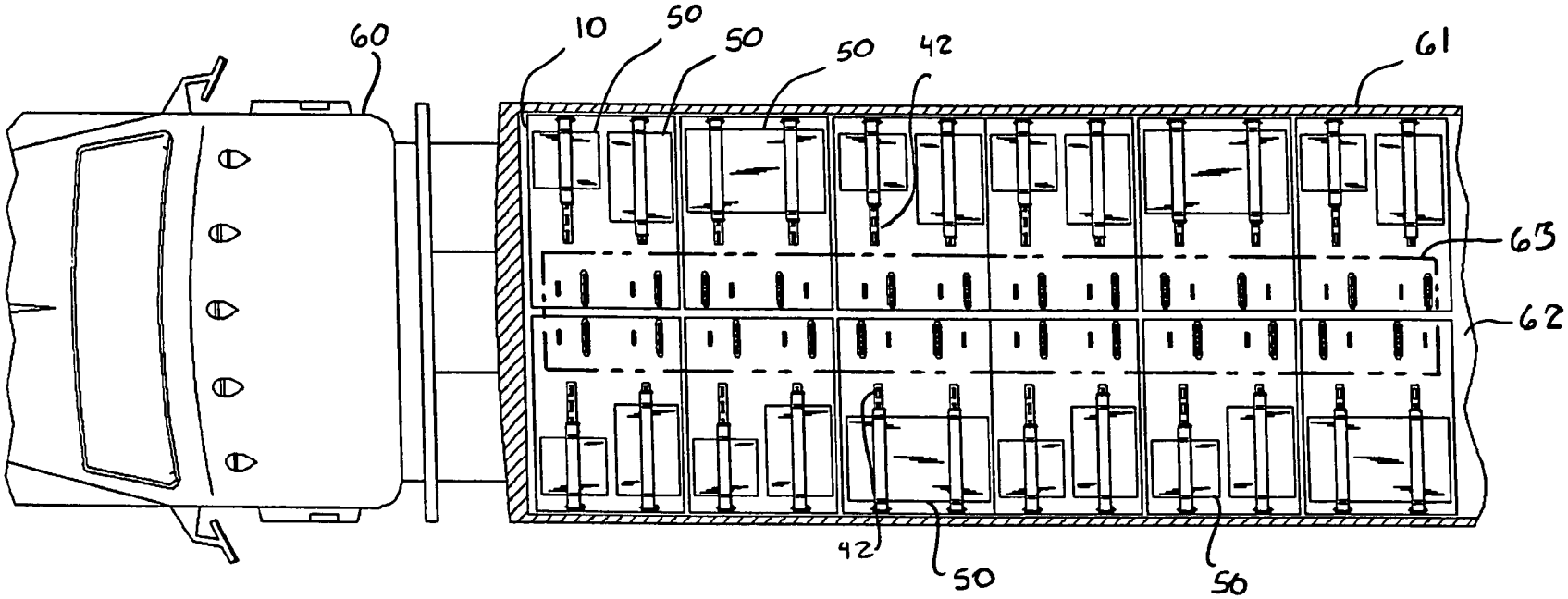
FIG. 16 is a cutaway plan view of the interior of a delivery truck having a plurality of pallets according to the present invention arranged therein.
Figure 17:
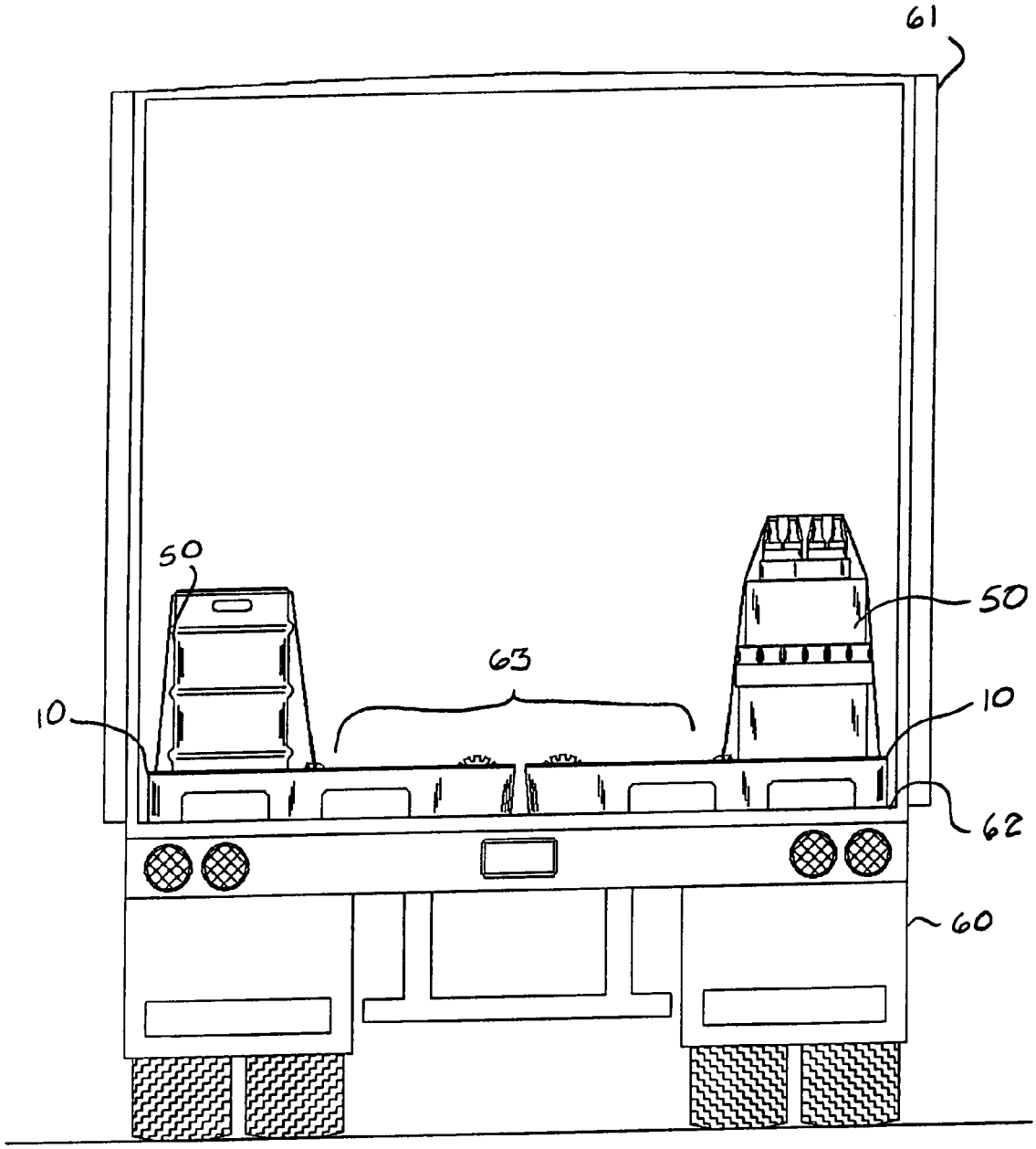
FIG. 17 is a rear view of the delivery truck of FIG. 16.

FIG. 16 is a schematic cutaway plan view of the inside of a delivery truck 60 illustrating an arrangement of pallets in an example of a method of using pallets according to the present invention to transport merchandise, while FIG. 17 is a schematic elevation of the delivery truck 60 of FIG. 16 as seen from the rear. The delivery truck 60, which may be of a conventional structure, has a body 61 for carrying merchandise mounted on the chassis of the truck 60. As shown in these figures, a plurality of pallets 10 according to the present invention are arranged inside the body 61 of the truck 60 on the floor 62 of the body 61 in a plurality of rows (extending in the widthwise direction of the truck) and columns (extending in the lengthwise direction of the truck). Each row comprises two pallets 10 facing each other and spanning most of the interior width of the body 61 of the truck 60 and defining a surface on which a worker can walk and roll a hand cart. The pallets 10 may have different dimensions from each other, but in the present embodiment, for simplicity, each of the pallets 10 has the same dimensions, with a width which is slightly less than ½ the interior width of the floor 62 of the body 61 of the truck 60. The width of each pallet 10 is preferably sufficiently smaller than ½ the width of the floor 62 of the truck body 61 that the pallets 10 can be easily arranged on the floor 62 of the truck body 61 but preferably not so much smaller than ½ the width that large gaps are formed between adjoining pallets 10 or between the pallets 10 and the interior walls of the truck body 61. An example of a suitable width for a pallet is 1.5-2 inches less than ½ the width of the interior of the truck body 61. For example, in a delivery truck having a body 61 with an interior width of 100 inches, two pallets having a width of 48 inches can easily be placed side by side in the widthwise direction of the delivery truck without the gaps between the pallets being too large. The length of the pallets 10 can be largely determined by the number and size of the loads to be disposed on each pallet. As an example, the pallets 10 shown in FIG. 16 have a width of 48 inches and a length of 38 inches. The pallets 10 are arranged so that the sloping side wall 13 of each pallet 10 faces the pallet 10 on the opposite widthwise side of the truck 60. When pallets according to the present invention are used with a tractor-trailer, the pallets may be arranged inside the trailer of the tractor-trailer in the same manner as shown in FIGS. 16 and 17.

When two opposing pallets 10 on opposite widthwise sides of a truck 60 are separated by a gap, the size of the gap measured in the widthwise direction of the truck is preferably sufficiently smaller than the width of the wheels of a hand cart so that a hand cart can roll along the gap without the wheels falling into the gap. The wheels of a hand cart typically have a width of 3 or more inches, so a gap between opposing pallets 10 is preferably at most 2 inches.

The space between the innermost ends of the tracks 42 of two opposing pallets 10 defines an aisle 63 along which a delivery person can pass while pulling a hand cart in order to access loads 50 of goods on the pallets 10. An example of a suitable width for the aisle 63 in order to give the delivery person sufficient room to maneuver in the aisle 63 and to turn the hand cart around if necessary is approximately 40 inches.

The arrangement shown in FIGS. 16 and 17 includes a single aisle 63 along the centerline of the truck 60, but there may be a larger number of aisles, and an aisle need not extend along the centerline of the truck 60. In FIG. 16, all the pallets 10 arranged on the floor 62 of a truck 60 and defining a surface on which a delivery person can walk are pallets according to the present invention like the pallet 10 shown in FIG. 1. However, conventional pallets not equipped with a winch or tie-down can be employed together with one or more pallets according to the present invention. For example, the pallets along one widthwise side of a truck can be pallets according to the present invention, while the pallets on the opposite widthwise side of the truck can be empty pallets of conventional design. The empty conventional pallets can form an aisle along a widthwise side of the truck along which a delivery person can roll a hand cart to access the loads on the pallets according to the present invention disposed on the opposite widthwise side of the truck.

Each of the pallets 10 can be individually transported into or out of the truck body 61 by a fork lift having forks which can be engaged with the openings 14 in the pallet 10. Here, a fork lift includes all types of wheeled devices equipped with forks and capable of lifting and transporting a load, including equipment in which the operator is sitting or standing on the fork lift as well as equipment with which the operator stands on the ground while operating the fork lift, such as motor-driven or hand-pulled pallet jack. A load 50 may be disposed on a pallet 10 after the pallet 10 has been transported into the truck 60, but it is particularly efficient to first secure a load 50 atop a pallet 10 disposed outside of the truck 60 (such as in a warehouse or factory) and then to transport the loaded pallet 10 into the truck body 61 with a fork lift. Loaded pallets 10 can be transported into the truck body 61 one by one and placed on the floor 62 of the truck body 61, starting from the front of the truck 60 and working towards the rear. The pallets 10 can be removed from the truck body 61 by a fork lift by the reverse procedure, starting from the rear of the truck. When the pallets 10 are being removed from the truck body 61 while still loaded with merchandise, they can be removed from the truck body 61 one by one. However, if the pallets 10 which are being removed from the truck body 61 are empty, the fork lift can first stack a plurality of empty pallets 10 on top of each other while they are still inside the truck body 61, and then the fork lift can remove a stack of the pallets 10 from the truck body 61 at one time.

The process of securing a load atop a pallet 10 is typically as follows. The worker performing the loading first disconnects the free end of one of the tie-downs 40 from the corresponding track 42 and moves the tie-down 40 away from the region on the top surface 12*a* of the pallet 10 where the load is to be placed. He then places the load atop the pallet 10. The worker then moves the pawl 35 of the ratchet mechanism 33 to its disengaged position to allow the winch 30 to freely rotate, and he passes the tie-down 40 over the top of the load and attaches the free end of the tie-down 40 to one of the openings 43 in the track 42 by means of the fitting 41 attached to the free end of the tie-down 40. At this time, the tie-down 40 only loosely contacts the load, so in order to tighten the tie-down 40 against the load, the worker moves the pawl 35 to its engaged position and then rotates the kick wheel 36 with his foot to wind up the tie-down 40 on the corresponding winch 30. After the worker has rotated the kick wheel 36 as far as he can with his foot, if he desires to further tighten the tie-down 40, he can engage a lever 45 with one of the teeth 36*a* of the kick wheel 36 and further rotate the kick wheel 36 with the lever 45. When the tie-down 40 has been sufficiently tightened, the lever 45 is disengaged from the kick wheel 36. The winch 30 is prevented by the ratchet mechanism 33 from rotating backwards to loosen the tie-down 40.

When a worker, such as a delivery person, desires to remove all or a portion of a load from a pallet 10, he first uses the lever 45 to slightly rotate the kick wheel 36 far enough in the direction increasing the tension in the tie-down 40 (the clockwise direction in FIG. 4) in order to reduce the force applied to the pawl 35 by the ratchet wheel 34. When the force applied to the pawl 35 by the ratchet wheel 34 has been sufficiently reduced, the worker pivots the pawl 35 to its disengaged position. In this state, the drum 32 of the winch 30 is free to rotate in the counterclockwise direction in FIG. 4 to release the tension acting on the tie-down 40. Once the tension in the tie-down 40 is released, the free end of the tie-down 40 can be disconnected from the track 42. With the tie-down 40 no longer restraining the load, the worker can remove as much of the load as he needs, place it on a hand cart, and roll the hand cart out of the truck body 61 along the aisle 63 formed atop the pallets 10. If the worker removes only a portion of a load, he can retighten the tie-down 40 against the remaining portion of the load by rotating the kick wheel 36 in the same manner as described above. If the worker removes an entire load from the pallet 10, he preferably then takes up the slack in the tie-down 40 so that it will not become entangled in objects. The free end of the tie-down 40 may be left unconnected to the track 42 and the tie-down 40 can be tightened until the fitting 41 of the tie-down 40 is pulled against the corresponding slot 17 in the pallet 10, or the free end can be connected by the fitting 41 to one of the openings 43 in the corresponding track 42 and then tightened until the tie-down 40 lies flat against the top surface 12*a* of the pallet 10 in the manner shown in FIG. 1.

A conventional delivery truck for beverages is not intended to be used with a loading dock and requires the delivery person to stand on the ground outside the truck when unloading merchandise from the truck. In addition, merchandise within a conventional beverage delivery truck must be lowered from the truck by hand and placed onto a hand cart at the time of delivery. In contrast, a delivery truck employing pallets according to the present invention can be pulled up to a loading dock and unloaded or unloaded with the floor of the body of the truck at substantially the same height as the loading dock. When the delivery person is standing on the pallets inside the delivery truck, the loads are stacked at the level of his feet, and he can transfer an entire load onto a hand cart by simply slipping the hand cart underneath the load, and the loaded hand cart can be rolled out of the truck body and onto the loading dock.

If the delivery truck is equipped with a lifting mechanism (commonly referred to as a lift gate) for raising and lowering loads between the ground and the body of the truck, the delivery truck can make deliveries to retail establishments not equipped with a loading dock while still enabling the delivery person to transfer merchandise out of the truck on his hand cart without having to do any lifting of the merchandise. If the lift gate is raised to the level of the floor of the truck body or to the level of the top surface of the pallets disposed on the floor of the truck body (whichever level is more convenient for the delivery person), the delivery person can roll a loaded hand cart from atop the pallets onto the lift gate, lower the lift gate to the ground, and then roll the hand cart from the lift gate onto the ground and into the retail establishment.

Whether a delivery truck carrying pallets according to the present invention is used with or without a loading dock, the delivery person can be shielded from the weather while transferring merchandise from the pallets onto his hand cart, and he is not required to do any heavy lifting to remove a load from his delivery truck. As a result, the use of a pallet according to the present invention reduces the physical burdens on the delivery person and contributes to a decrease in fatigue, sickness, and work-related injuries of delivery persons.

What is claimed is:

1. A pallet for supporting a load comprising:

a pallet body having a deck with a top surface for supporting a load and an opening in the deck;

a foot-driven winch mounted on the pallet body and including a rotatable drum having a rotational axis disposed beneath the deck and a kick wheel which is connected to and rotatable with the drum and which extends through the top surface of the pallet body and which can be rotated by foot by a user to rotate the drum, the opening in the deck enabling a user to rotate the kick wheel by foot while standing atop the deck; and a flexible tie-down for restraining a load on the pallet body connected to the winch and wrapped around the drum.

2. A pallet as claimed in claim 1 wherein the kick wheel comprises a disk.

3. A pallet as claimed in claim 1 wherein the kick wheel has a plurality of teeth on its outer periphery.

4. A pallet as claimed in claim 1 wherein the kick wheel comprises a cylinder.

5. A pallet as claimed in claim 4 wherein the cylinder has an opening formed in a periphery thereof for insertion of a lever to rotate the kick wheel.

6. A pallet as claimed in claim 1 wherein the tie-down can be detachably secured to the top surface of the pallet body in a plurality of locations.

7. A pallet as claimed in claim 6 including an elongated track secured to the pallet body and having a plurality of openings, wherein the tie-down includes a fitting detachably engageable with any of the openings in the track.

8. A pallet as claimed in claim 1 having a side wall which is sloped inwards with respect to the vertical from an upper end towards a lower end of the pallet.

9. A method of restraining a load on a pallet as claimed in claim 1 comprising disposing a load on the body of the pallet, passing the tie-down over the load, connecting an end of the tie-down to the pallet body, and rotating the winch by foot to tighten the tie-down against the load.

10. A method of delivering merchandise comprising:

disposing a load of merchandise on each of a plurality of pallets each of which is a pallet as claimed in claim 1;

securing each load to the pallet on which it is disposed with the tie-down of the pallet to form a plurality of loaded pallets;

transporting each of the loaded pallets into a vehicle and placing the pallets on a floor of the vehicle to define a surface substantially spanning a width of the floor of the vehicle, the loads on the pallets defining an aisle along which a hand cart can be rolled atop the surface;

driving the vehicle to a location to which merchandise is to be delivered;

rolling a hand cart along the aisle to a load containing the merchandise to be delivered at the location;

transferring the merchandise to be delivered from the pallet to the hand cart; and rolling the loaded hand cart along the aisle and out of the vehicle.

11. A method as claimed in claim 10 wherein the merchandise comprises beverages.

12. A method as claimed in claim 10 including rolling the loaded hand cart from the interior of the vehicle onto a loading dock adjoining the vehicle.

13. A pallet as claimed in claim 1 wherein the pallet body has an interior and an exterior, and the winch is mounted on the interior of the pallet body.

14. A pallet for supporting a load comprising:

a pallet body having a deck with a top surface for supporting a load and an opening in the deck;

a foot-driven winch mounted on the pallet body and including a rotatable drum having a rotational axis disposed beneath the deck and a kick wheel which is connected to and rotatable with the drum and which can be rotated by foot by a user to rotate the drum and which extends through the opening in the deck to above the deck, the opening in the deck enabling a user to rotate the kick wheel by foot while standing atop the deck; and a flexible tie-down for restraining a load on the pallet body connected to the winch and wrapped around the drum.

15. A pallet for supporting a load comprising:

a pallet body having a top surface for supporting a load, the top surface having an opening;

a foot-driven winch mounted on the pallet body and including a rotatable drum and a kick wheel which is connected to and rotatable with the drum and which can be rotated by foot by a user to rotate the drum; and a flexible tie-down for restraining a load on the pallet body which is connected to the winch and is wrapped around the drum and extends inside the pallet from the drum through an opening in the top surface of the pallet body and passes through the opening from the interior to the exterior of the pallet body.

16. A pallet as claimed in claim 15 wherein the pallet body has openings for inserting forks of a fork lift into the pallet body, the pallet body includes guard plates inside the pallet body aligned with the openings for forks of a fork lift, and the tie-down passes inside the pallet above the guard plates between the drum and the opening for the tie-down.

17. A pallet as claimed in claim 6 wherein the plurality of locations where the tie-down can be detachably secured to the top surface are disposed along a straight line extending perpendicular to the rotational axis of the drum.

18. A pallet as claimed in claim 1 wherein the pallet body has dimensions in plan selected from 32×36 inches, 28×38 inches, 40×48 inches, and 48×48 inches.

19. A method as claimed in claim 10 including placing the pallets on the floor of the vehicle in first and second columns extending in a lengthwise direction of the vehicle and a plurality of rows extending in a widthwise direction of the vehicle with each row substantially spanning the width of the floor of the vehicle, wherein the tie-down of each pallet is secured to the top surface of the pallet so that the aisle is defined between the tie-downs of the pallets in the first and second columns.

20. A pallet as claimed in claim 1 wherein the winch includes a ratchet mechanism having a ratchet wheel rotatable with the drum and a pawl pivotable with respect to the ratchet wheel between an engaged position and a disengaged position, the pawl being accessible by hand by a user standing atop the deck.

21. A pallet as claimed in claim 1 wherein the pallet body has openings in a side of the pallet body for inserting forks of a fork lift into the pallet body beneath the deck in a direction parallel to the rotational axis of the drum to enable the pallet to be lifted by a fork lift.

22. A method as claimed in claim 9 including applying a torque to the winch with a lever to tighten the tie-down against the load.

23. A method as claimed in claim 22 including applying a torque to the winch by engaging the lever with the kick wheel.

24. A method as claimed in claim 23 wherein applying a torque to the winch comprises fitting an end of the lever over one of a plurality of teeth formed on a periphery of the kick wheel.

25. A method as claimed in claim 22 wherein the winch includes a rotatable shaft secured to the drum, and applying a torque to the winch comprises inserting the lever through the deck into an opening formed in the shaft.

26. A method as claimed in claim 25 including inserting the lever into the opening in the shaft through the opening in the deck.

27. A method as claimed in claim 23 wherein applying a torque to the winch comprises engaging the lever with an opening formed in a periphery of the kick wheel.

28. A pallet as claimed in claim 4 wherein the kick wheel comprises a horizontal pipe rotatable with the drum.

29. A method as claimed in claim 10 wherein each pallet has a sloping side wall which is sloped inwards with respect to the vertical from an upper end towards a lower end of the pallet, and each pallet is placed on the floor of the vehicle with its sloping side wall opposing a side wall of another of the pallets.

30. A pallet as claimed in claim 8 wherein the side wall is sloped inwards by 4 to 10 degrees with respect to the vertical.

31. A method as claimed in claim 9 wherein rotating the winch by foot comprises rotating the kick wheel by foot with a foot contacting the kick wheel.

32. A method as claimed in claim 31 including rotating the kick wheel by foot while standing atop the deck of the pallet body.

33. A pallet as claimed in claim 7 wherein the track comprises a metal strip in which the openings for engaging the fitting are formed and which is secured to the deck.

* * * * *